United States Patent [19]

Russell

[11] 4,267,405

[45] May 12, 1981

[54] STEREO SPEAKER SYSTEM FOR CREATING STEREO IMAGES

[75] Inventor: Roger H. Russell, Binghamton, N.Y.

[73] Assignee: McIntosh Laboratory, Inc., Binghamton, N.Y.

[21] Appl. No.: 45,709

[22] Filed: Jun. 5, 1979

[51] Int. Cl.[3] ..... H04R 5/02

[52] U.S. Cl. ..... 179/1 E; 179/1 GA

[58] Field of Search ..... 179/1 G, 1 GA, 115.5 PS, 179/116, 1 E, 1 AT

[56] References Cited

U.S. PATENT DOCUMENTS

| | | | |
|---|---|---|---|
| 3,052,758 | 9/1962 | Berry | 179/1 E |
| 3,125,181 | 3/1964 | Pawlowski | 179/1 E |
| 3,138,667 | 6/1964 | Avedon | 179/1 E |
| 3,299,206 | 1/1967 | Klepper | 179/1 E |
| 3,308,237 | 3/1967 | Novak | 179/1 E |
| 3,980,829 | 9/1976 | Beveridge | 179/1 GA |

FOREIGN PATENT DOCUMENTS

| | | | |
|---|---|---|---|
| 1122851 | 8/1968 | United Kingdom | 179/1 GA |

OTHER PUBLICATIONS

*Audio,* "Acoustic Matrixing–A Basis For New Loudspeaker Developments", Nov. 1960, pp. 19–21.

*Audio Cyclopedia,* Howard M. Tremaine, 3–29–77, pp. 1153–1156.

"Columnar Loudspeakers", *Industrial Electronic Engineering and Maintenance,* Sep. 1962, pp. 22–25, George Riley.

*Primary Examiner*—Gerald L. Brigance

*Attorney, Agent, or Firm*—Pollock, Vande Sande & Priddy

[57] ABSTRACT

A stereo speaker system adapted for home use is arranged to increase stereo image perception by reducing spurious and confusing sound images. The speaker system includes a pair of low frequency speaker assemblies and a pair of high frequency speaker assemblies. The pair of low frequency speaker assemblies can be constructed along conventional lines although a columnar arrangement of speakers or acoustic transducers is preferred and preferably arranged to handle acoustic energy in a frequency range below 1000 Hz. The remaining portion of the speaker system includes a pair of high frequency speaker assemblies. Each assembly consists of a single column arrangement of a plurality of acoustic transducers or speakers; in one preferred embodiment, 24 high frequency speakers are included. The speakers are mounted in a column with minimum spacing between them; the number of speakers is chosen so that the column will extend substantially between floor and ceiling, with appropriate allowance for pre-existing structures such as baseboards, moldings or baseboard heating apparatus. The column of high frequency speakers is arranged to emit acoustic energy only in a forward direction so as to disperse acoustic energy as a cylindrical wavefront. At the same time, the acoustic energy emitting surfaces of a column of speakers is mounted as closely as possible to a supporting parallel surface such as a wall.

10 Claims, 9 Drawing Figures

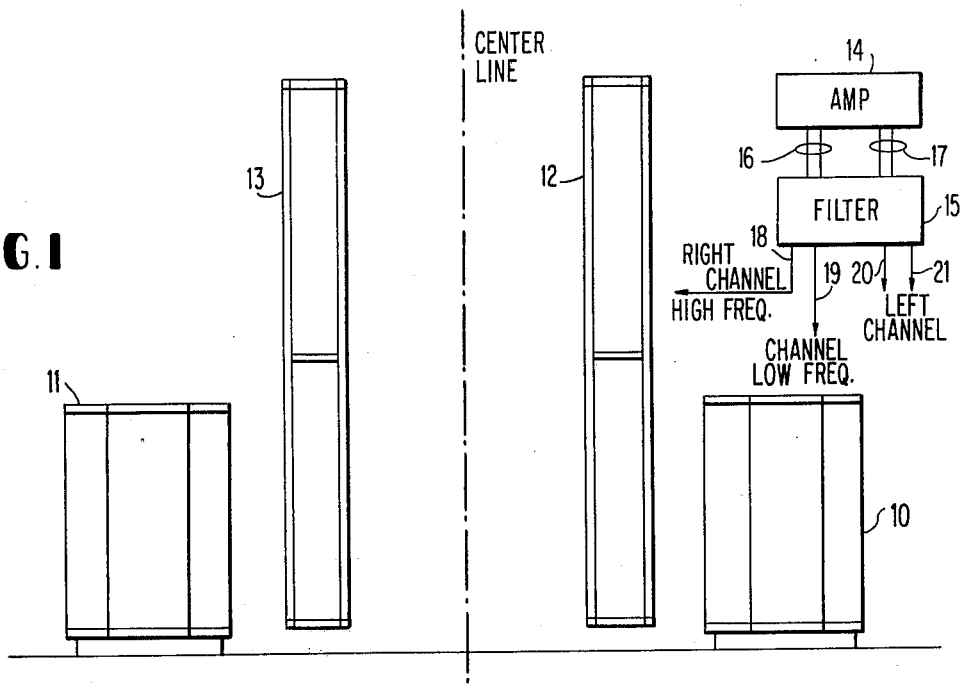
FIG. 1
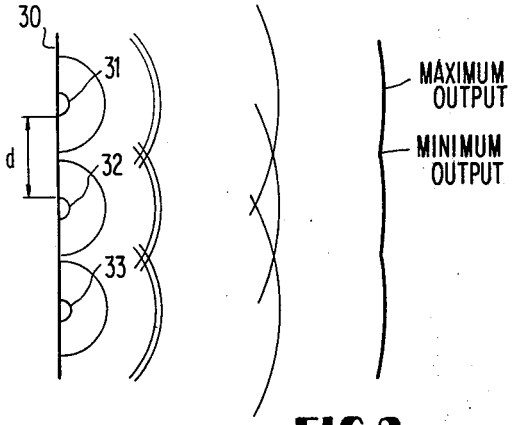
FIG. 2a
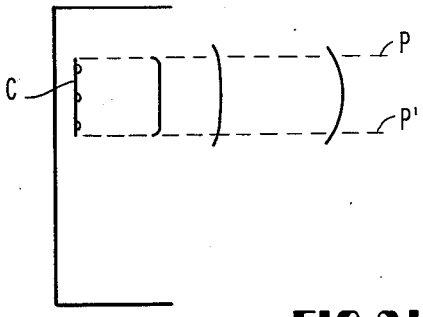
FIG. 2b
FIG. 3
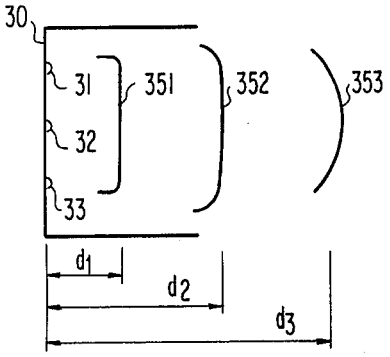
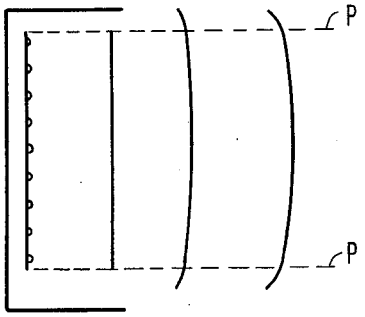
FIG. 2c FIG. 4
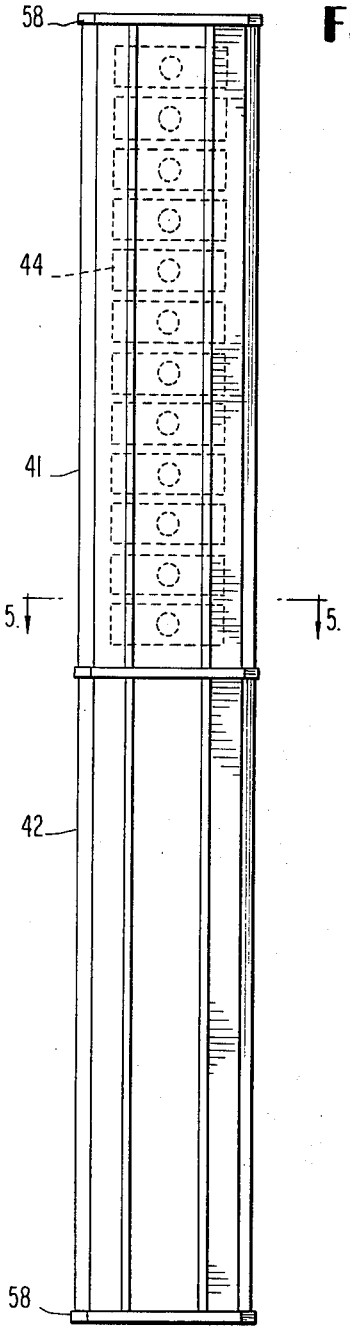
FIG. 6
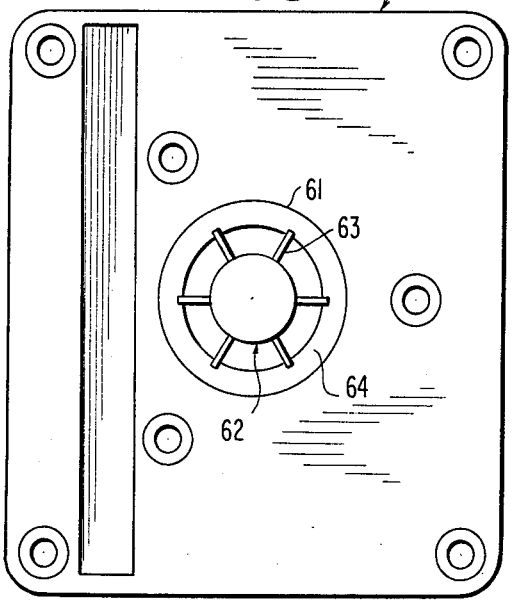
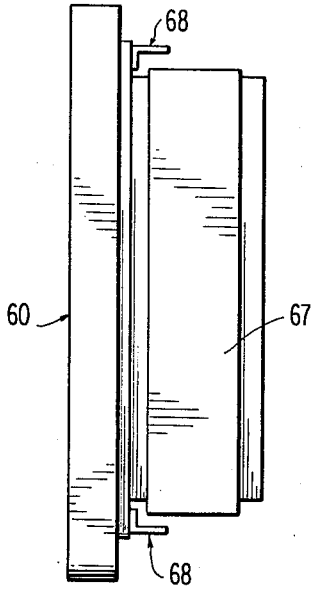
FIG. 7
FIG. 5
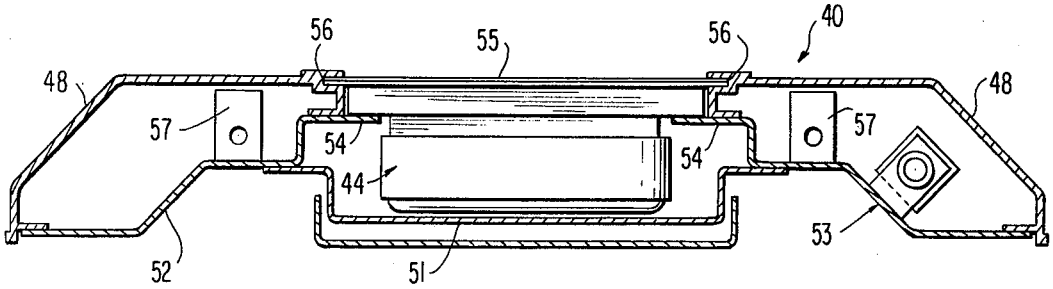

STEREO SPEAKER SYSTEM FOR CREATING STEREO IMAGES

FIELD OF THE INVENTION

The present invention relates to high fidelity apparatus for converting electrical energy to acoustic energy arranged to maximize the creation of a true stereo image.

BACKGROUND OF THE INVENTION

The high fidelity industry has the goal of converting recorded or broadcast program material into acoustic energy in such a fashion that the apparatus is transparent to the listener, in that he perceives no substantial difference between "live," recorded or broadcast programs. One very important advance in the field has been the recognition of the advantages of stereo sound reproduction. However, experience with stereo equipment has led to the realization that merely reproducing acoustic energy in stereo format is not the ultimate in sound reproduction. As more experience is gained, further characteristics are identified which are essential to give reproduced sound the quality and feel of "live" sound. One factor whose importance has been recognized when multiple speakers are employed is phasing such that the multiple speakers truly add to, and not detract from, the resultant sound. With proper recording and reproducing techniques, an audio "image" can be created allowing the listener to locate, in three dimensions, the virtual source or sources of the sound. This effect can quite easily be destroyed by improper phasing from plural speakers, by unwanted reflections from walls, ceilings, etc.

Beveridge, in U.S. Pat. No. 3,668,335, and in "Some Reflections on Sound Reproduction for the Home," advocates a system producing acoustic energy dispersing in a cylindrical wavefront. Theoretically, such an arrangement is desirable, however, implementing a system of this type is difficult.

Beveridge suggests a transducer or speaker simulating a narrow slot in a wall. This should eliminate near images which can confuse the listener, reduce intensity variations and eliminate off-axis delay problems. Implementation was with a long, ribbon-like electrostatic transducer covering the entire audio range. The implementation has several significant drawbacks:

(1) the peak acoustic output capacity of the electrostatic transducer is too limited for adequate results;

(2) the electrostatic ribbon is so directional that an acoustic lens is required for adequate angular dispersion—the presence of the lens with its substantial size inhibits the effect of a narrow slot in the wall goal;

(3) the low frequency response is poor; this has led to the use of a supplementary sub-woofer.

Other attempts to improve sound quality are especially hampered in the high audio frequency range where a number of problems are present;

(1) the conventional dynamic high frequency speaker (or tweeter) is also limited in power handling capacity to about 20 watts which is inadequate for almost any application, the electrostatic alternative is even less attractive;

(2) if multiple speakers are employed in the high frequency range the transducer assembly must be arranged to minimize unwanted reflection, which is difficult since the wavelength is short; and (3) the multiple tweeters must be arranged so as to avoid phasing inaccuracies and without their physical location or interaction producing undesirable reflections.

The prior art evidences speaker systems comprising plural dynamic transducers. One such speaker assembly includes a columnar arrangement of six 1½ inch dome midrange drivers nominally handling the frequency range 600 Hz. to 4 kHz. placed adjacent and parallel to a 48-inch strip electromagnetic induction radiator nominally handling the frequency range 4 through 32 kHz. While this high frequency speaker assembly is capable of greater power output than is the electrostatic Beveridge arrangement, the parallel but displaced line sources consisting of the continuous ribbon electromagnetic induction tweeter and the six dome speakers can produce phase differences which tend to confuse the listener and inhibit the creation or recreation of true stereo image.

Another arrangement has an electromagnetic panel which is neither a dynamic speaker nor an electrostatic speaker. However, it is a dipole radiator, and accordingly, it cannot be positioned against a vertical surface, and must, of necessity, rely on reflections which, unless properly handled, can create the same audio confusion which destroys stereo image perception as was evident in the other prior art.

It is therefore one object of the present invention to provide a stereo speaker system which is arranged to increase stereo image perception by reducing spurious and confusing sound images. It is another object of the present invention to provide a high frequency speaker system as aforesaid, which is arranged to provide increased stereo image perception by reducing spurious and confusing sound images. It is another object of the present invention to provide a high frequency speaker assembly for use in such a system with wide dynamic range which does not degrade fidelity to achieve that range. It is a further object of the present invention to provide a high frequency speaker assembly as aforesaid, which is implemented to disperse acoustic energy as a substantially cylindrical wavefront, from floor to ceiling. It is yet another object of the present invention to provide a high frequency speaker assembly which is capable of coupling a cylindrical wavefront to a listener, and which at the same time, minimizes reflections which are capable of causing confusion in the perception of a stereo image by a listener. It is a further object of the invention to provide such high frequency speaker assembly arranged to respond to audio frequencies in a range of about 1000 Hz. and higher.

SUMMARY OF THE INVENTION

These and other objects of the invention are met by providing a high frequency speaker assembly for use in a stereo speaker system which is adapted for home or similar use, i.e., in a room defined by horizontal and vertical surfaces and arranged to increase stereo image perception by reducing spurious and confusing sound images. The high frequency speaker assembly referred to above consists of a plurality of high frequency speakers having front and rear surfaces and mounted parallel to one surface of a room radiating acoustic energy, in the audio frequency range above 1000 Hz., only from the front speaker surface. In addition, the high frequency speaker assembly includes means for mounting the speakers in a single column with minimum distance between adjacent speakers, the plurality being of such a number that a column so formed will substantially completely extend between surfaces perpendicular to the one surface of a room. The close spacing of the speakers and the relatively large extent of the column results in a relatively large number of speakers which provides the capability of wide dynamic range. The column of speakers so formed may be mounted on a vertical surface defining that room with the front surfaces of the speakers mounted to minimize the distance between that front surface and the vertical surface room defining surface.

A stereo speaker system includes, in addition to a pair of such high frequency speaker assemblies, a further pair of low frequency speaker assemblies for radiating acoustic energy in the audio frequency range below 1000 Hz. The low frequency speaker assemblies may be formed in accordance with the teachings of Russell, U.S. Pat. No. 3,715,501. Preferably, the pairs of low and high frequency speaker assemblies are arranged in mirror image fashion with the low frequency speaker assemblies being placed furthest from an imaginary center line, and the pair of high frequency speaker assemblies equally displaced from the center line and within the pair of low frequency speaker assemblies.

BRIEF DESCRIPTION OF THE DRAWINGS

The invention will be further described when taken in conjunction with the following drawings, in which:

FIG. 1 is a schematic illustrating placement and energization of the assemblies forming the inventive system;

FIGS. 2A–2C and 3 are useful in illustrating several principles;

FIG. 4 is a front view of a speaker assembly;

FIG. 5 is a cross-section of FIG. 4; and

FIGS. 6 and 7 are front and side views of a typical high frequency speaker.

DETAILED DESCRIPTION OF A PREFERRED EMBODIMENT

FIG. 1 is a plan view of a preferred embodiment of the stereo speaker system of the present invention. As shown in FIG. 1, a pair of low frequency speaker assemblies 10 and 11 are provided which are located equal distance from an imaginary center line of the speaker system. The low frequency speaker assemblies 10 and 11 may conveniently be supported by a horizontal surface such as a floor. A pair of high frequency speaker assemblies 12 and 13 are also provided and each is mounted an equal distance from the imaginary center line in mirror image fashion, inside its adjacent low frequency speaker assembly 10 and 11, respectively. Preferably, the high frequency speaker assemblies 12 and 13 extend substantially from floor to ceiling, although in practical implementation, due allowance can be made for existing apparatus such as baseboards, molding or baseboard heating equipment. The high frequency speaker assemblies 12 and 13 are relatively thin and may be supported on a convenient surface, for example, a vertical surface such as a wall.

Diagrammatically illustrated in FIG. 1 is the apparatus for driving the high and low frequency speaker assemblies. This apparatus includes a stereo amplifier 14 having a right channel output indicated by the conductors 16, and a left channel output indicated by the conductors 17. The signals on these outputs are coupled to a filter network 15. The filter network 15 is arranged, in conventional fashion, so as to produce a pair of outputs for each of the right and left channels, respectively. A first pair of outputs, for example, corresponding to the right channel, includes a right channel low frequency output on a conductor pair 19, and a right channel high frequency output on a conductor pair 18. Similar high and low frequency left channel outputs are represented by a conductor pair 20 and 21. Filter networks such as the filter network 15 are conventional in the art and no further description of the filter network 15 or the stereo amplifier 14 is believed necessary.

The left and right channel high frequency outputs are coupled to the left and right high frequency speaker assemblies 13 and 12, respectively. Similarly, the left and right channel low frequency outputs are coupled to the left and right low frequency speaker assemblies 11 and 10, respectively.

While the speaker assembly of the present invention can be located on either a long or short wall of a listening room, preferably, it is located along the longer wall. For locating the various speaker assemblies, the wall is divided into thirds and the high frequency speaker assemblies are located one-third of the distance from the end of each wall. Each of the low frequency speaker assemblies is preferably located about 8 inches from its adjacent high frequency speaker assemblies as illustrated. Those skilled in the art will appreciate that other locations can be employed for best listening results depending on the surrounding circumstances. For example, in some applications, the entire speaker assembly can be mounted on a ceiling.

Although the objective of the high frequency speaker assembly is to radiate an essentially cylindrical wavefront, an exactly cylindrical wavefront will only be radiated by a continuous line radiator, and for reasons of adequate power handling capacity, the high frequency speaker assemblies 12 and 13, shown in FIG. 1, consist of a column of discrete speakers. Because of the wide frequency range handled by a speaker assembly, the different effects physical surroundings have on the various frequency components of the audio output and the changes in amplitude levels of different audio energy components, exact mathematical descriptions are too complicated and limited to be useful. However, research allows several principles to be stated, and these will be explained in connection with FIGS. 2 and 3.

FIG. 2A illustrates a plurality of acoustic transducers 31–33 mounted in the plane 30, and a cross-section of the resulting amplitude of acoustic energy radiated thereby. The resultant acoustic energy at any point is the sum of the energy radiated to that point from the plurality of transducers 31–33. However, the difference between the maximum output and the minimum output, at any given distance from the plane 30 depends upon the distance d between adjacent radiators. Thus, in order to approximate the desired cylindrical wavefront as closely as possible, the distance d is minimized and in one embodiment of the invention, the distance between the edge of adjacent radiators is on the order to 2.1 inches.

The foregoing analysis holds true for different points located within the height of the column of radiators 31–33. Not illustrated in FIG. 2A is the fact that outside this area, diffraction effects result in poor response.

A further factor must be taken into account, however, beyond the necessity for closely spacing the plurality of radiators in a column of transducers in order to provide the desired cylindrical wavefront. More particularly, reflections from horizontal surfaces and cancellation of acoustic energy by reason of phase differences tends to cause the amplitude to vary as a function of position along the column as well as distance from the column. Thus, as shown in FIG. 3, a column of transducers including transducers 31–33 is closely spaced enough so that, at short distances, for example, the distance $d_1$, the wavefront 351 is approximately cylindrical. However, as the distance from the column 30 increases, for example, at distances $d_2$ or even $d_3$, the wavefront loses its cylindrical character so that there is a definite maximum point of response as a function of distance along the column, and at substantial distances from this point, the acoustic energy is much less than desirable, i.e., there is a notable variation in high frequency acoustic energy as a function of height. In order to minimize or reduce this undesirable phenomenon, the column of radiators should ideally extend completely between the adjacent perpendicular faces. Practical considerations dictate that the ideal will only be approached and not achieved. In particular, the presence of baseboards or even baseboard heating equipment as well as the possibility of ceiling molding, limit the height of the radiating column to the available flat wall surface. If appropriate allowances are made at the top and the bottom, the usable listening volume will occupy the vast majority of the available volume and the portions of the volume within which the wavefront is not truly cylindrical will be those portions, i.e., very near the ceiling or very near the floor which are not likely to be used for listening purposes. Accordingly, the high frequency speaker assembly is arranged so that the column substantially completely extends between horizontal surfaces defining the listening room. This is illustrated in FIGS. 2B and 2C which illustrate the difference in response for a "short" column and a "long" column. In this context, a "short" column is a column whose vertical extent is not of a length to encompass the usable listening volume whereas a "long" column does encompass the usable listening volume. FIG. 2B shows a "short" column C whose vertical extent lies within the projection P and P′ of its end points. The curves 351, 352 and 353 show audio amplitude at different distances for a representative frequency. Inside the projection, P and P′ listening levels at least within reasonable distances (say, up to 30–60′), are adequate, while outside the projections P′ and P, the audio level drops off sharply. The long column of FIG. 2C, on the other hand, since its end point projections encompass the vast majority of the listening volume, minimize the portion of the total volume subjected to impaired response.

As has been mentioned above, reflections, such as from walls and other protruding surfaces, can cause spurious and confusing sound images which detract from the listener's perception of a stereo image. Indeed, some speaker systems themselves cause such reflections. Ideally, the columnar acoustic radiator should be mounted flush, and exist as a long vertical slot in an infinitely long plane, or the practical equivalent thereof, i.e., a slot in a wall in a room. Again, practical considerations will not allow achievement of this goal, but technical considerations require that, first the columnar radiator be mounted flush against the wall, and second, the depth of the columnar radiator, that is, the distance between the mounting wall and the emitting surface of the radiator be minimized. In a practical embodiment of the invention, which will be disclosed in connection with FIGS. 4–9, that distance is on the order of 1.7 inches.

Likewise, the radiating surface and extensions of that surface should extend as far as possible on either side of the center line in order to reduce edge reflections in the critical pass band and consequent interference from secondary reflections. This is achieved, in the same practical embodiment to be disclosed hereinafter, by providing that the surface in which the speaker is supported extends at least four inches on either side of the theoretical center line and by employing rounded and sloping contours of a cross-section of the speaker assembly in a horizontal plane.

As previously indicated, the transmission of acoustic energy from a speaker assembly is impossible to describe with mathematical exactness. This is for the reason that the wavelength of the energy determines, to a large extent, the dispersion of the acoustic energy within any given volume and the effect on that dispersion of various edges, corners and reflecting surfaces. The same holds true even though the speaker assembly radiates energy in a restricted frequency range, such as the acoustic range above 1000 Hz., as is radiated by the inventive speaker assembly. For that reason, the following remarks which reflect the results of a study in the dispersion of acoustic energy are, to a large extent, of a general nature, and apply to the installation of the inventive speaker assembly in a variety of listening rooms. It is apparent that no single speaker is capable of dispersing in the entire range of frequencies of interest, in the desired pattern, and for that reason, stereo systems typically employ not only a plurality speakers, but a plurality of speaker assemblies. While systems in the prior art have broken up the entire acoustic range into a variety of segments, the present invention is based upon the understanding that adequate response can be achieved by employing only two segments of the entire acoustic range, a first segment below 1000 Hz. in which the wavelengths of the energy are so long that the fine geometry to be considered hereinafter simply plays no part in proper dispersion and an acoustic range above 1000 Hz in which, due to the short wavelengths involved, close attention must be paid to geometrical considerations in order to insure proper phasing of the energy throughout a large percentage of the listening volume available.

The inventive high frequency speaker assembly such as the assemblies 12 or 13 is comprised of a number of components, a mounting member or enclosure arranged to support a plurality of acoustic speakers with a backplate, a wall mounting plate, a grill cloth, and the apparatus to secure the grill cloth to the mounting member, and to secure the speakers to the mounting member. FIG. 4 shows a typical high frequency speaker assembly 12. For convenience, the assembly 12 comprises identical upper and lower sub-assembly 41 and 42, respectively. The assemblies are joined at 43 when mounted. Each assembly comprises a mounting member for supporting a columnar arrangement of a plurality of speakers 44. FIG. 4 shows, in phantom, the speakers 44 of the upper sub-assembly 41.

In line with the desire to derive an essentially cylindrical wavefront the mounting member is arranged to extend substantially between horizontal surfaces defining a room such as the floor and ceiling, although slightly foreshortened for practical reasons discussed above. In a preferred embodiment of the invention, the combined mounting member length of both sub-assemblies is approximately 76½″ long. To simplify shipping problems, the mounting member actually comes in two segments, each a little over 38″ in length. FIG. 5 is a cross-section of FIG. 4 taken on the line 5-5′. Referring first to FIG. 5, the mounting member segment has a front face 40 and a rear face 45. The front face is generally parallel to the rear face 45 except for the presence of rounded and sloping shoulders 48 (sloping at about 45°), for the purpose of minimizing edge reflections.

Starting at a supporting surface, not illustrated, a wall plate 50 is supported by the surface. A hook arrangement (not illustrated) supports a back plate 51 and each of the remaining components. Secured to back plate 51, via welds, bolts or other conventional apparatus, is a pair of side covers 52 and 53, each of which forms part of the front surface 40. To minimize unwanted reflections, the side covers 52, 53 provide for an enclosure front surface which is large relative to the dimension of the speaker 44. For example, in one embodiment, a speaker having a 1" radiator the distance between the sloping shoulders, is over eight inches—that is a substantially planar front surface extends for over 8". Each speaker 44 is supported by extensions 54 of the side covers 52 and 53 via bolts, screws or the like. The speaker 44 is shown in more detail in FIGS. 6–7. A grill cloth 55 is slipped into slots 56 formed in opposed ends of the side covers 52 and 53 at the front surface 40. The side covers 52 and 53 also include a mounting member 57 for securing end caps 58 (see FIG. 4). Finally, a bracket 59 supports an electrical jack to which amplifier output conductors may be removably coupled and from which conductors are wired to carry the audio signal to coils of the speakers 44. In one embodiment of the invention, the wall and back plates and side covers are aluminum extrusions. In other embodiments, the side covers are pressed board, wood or the like.

The speakers 44 comprise a modified AD 0163/T8 speaker from North American Philips and is more particularly illustrated in FIGS. 6 and 7 which comprise front and side views, respectively. More particularly, as shown in FIG. 6, the speaker 44 includes a mounting plate 60 which is rectangular so as to comply with close mounting of adjacent speakers 44. A recess 61 is provided in the plate 60 to provide for a phasing plug 62 supported on a plurality of legs 63 over the dome diaphragm 64. Screws 65 join a magnet and coil assembly (shown in FIG. 6) to the plate 60 and the screws 66 join the speaker 44 to the side covers 52 and 53. FIG. 7 shows a side view of plate 60, magnet assembly 67 and electrical terminals 68.

In the preferred embodiment of the invention, the speaker-to-speaker spacing of about 3.1" is dictated by the extent of the magnet assemblies 67. That is the plate 60 is sized to provide for only minimal clearance between the magnet assemblies 67 of adjacent speakers 44. The magnet assemblies 67 in the preferred embodiment employ ferrite cores. However, if desired, the 3.1" spacing of speakers could be reduced by using Alnico cores which, because of the greater effectiveness of the core, can be reduced in size.

From the foregoing it should be apparent that the inventive high frequency speaker assembly minimizes impaired listening volume, minimizes spurious reflections and approaches the cylindrical dispersion goal by (1) the close spacing of the multiple speakers,
(2) the single column mounting,
(3) the form of the enclosure with its
(a) small depth
(b) surface extension of the radiator with sloping shoulders, and
(4) the extent of the column relative to adjoining surfaces.

Simultaneously, the dynamic range problem is overcome by the use of multiple speakers. If a single speaker is rated at 20 watts, the combined total of 24 can adequately handle 480 watts. This provides a 14 dB advantage over a single speaker. Adding to the advantage is the difference in response as a function of distance; the amplitude of a cyindrical wavefront is reduced directly with distance whereas the single speaker response is reduced as the second power of distance. Thus, the 14 dB advantage is increased as a function of distance from the radiator.

What is claimed is:

1. A stereo speaker system adapted for home use in a room defined by perpendicular surfaces and arranged to increase stereo image perception by reducing spurious and confusing sound images comprising:

a pair of low frequency speaker assembly means for radiating acoustic energy in the frequency range below 1000 Hz., a pair of high frequency speaker assembly means for radiating acoustic energy in the frequency range above 1000 Hz., each of said pair consisting of:

a plurality of high frequency dynamic speakers having front and rear surfaces and radiating acoustic energy only from said front surface, enclosure means for mounting said speakers in a single column with minimum distance between adjacent speakers, said plurality being of such number that said column will substantially completely extend between a pair of parallel surfaces defining one dimension of said room, said enclosure means supporting said assembly means adjacent a supporting surface perpendicular to said parallel surfaces and locating said front surface of said speakers to minimize distance between said front surface and said supporting surface.

2. The apparatus of claim 1 in which said enclosure means includes a front surface with a substantially planar area large compared to a dimension of said speaker.

3. The apparatus of claim 2 in which said enclosure means includes a front surface with rounded and sloping shoulders adjacent said planar area, said shoulders sloping towards said supporting surface.

4. The apparatus of claim 1 in which each said speaker includes a magnet assembly with said enclosure means supporting said speakers with distance between adjacent speakers determined by said magnet assemblies of adjacent speakers.

5. The apparatus of claim 1 wherein said enclosure means spaces front surface of said speakers from said supporting surface by a distance substantially determined by a dimension of a magnet assembly of said speakers.

6. A high frequency speaker assembly adapted for home use in a room defined by perpendicular surfaces and arranged to increase stereo image perception by reducing spurious, confusing sound images consisting of:

a plurality of high frequency speakers having front and rear surfaces and radiating acoustic energy in the frequency range above 1000 Hz. only from said front surface, enclosure means for mounting said speakers in a single column with a minimum distance between adjacent speakers, said plurality being of such number that said column will substantially completely extend between parallel surfaces defining one dimension of said room, said enclosure means supporting said assembly adjacent a supporting surface perpendicular to said parallel surfaces and locating said front surface of said speakers to minimize distance between said front surface and said supporting surface.

7. The apparatus of claim 6 in which said enclosure means includes a front surface with a substantially planar area large compared to a dimension of said speaker.

8. The apparatus of claim 7 in which said enclosure means includes a front surface with rounded and sloping shoulders adjacent said planar area, said shoulders sloping towards said supporting surface.

9. The apparatus of claim 6 in which each said speaker includes a magnet assembly with said enclosure means supporting said speakers with distance between adjacent speakers determined by said magnet assemblies of adjacent speakers.

10. The apparatus of claim 6 wherein said enclosure means spaces front surface of said speakers from said supporting surface by a distance substantially determined by a dimension of a magnet assembly of said speakers.

* * * * *